United States Patent [19]

Hanke

[11] 4,264,065

[45] Apr. 28, 1981

[54] FILM SPLICER

[75] Inventor: Rudolf Hanke, Monheim, Fed. Rep. of Germany

[73] Assignee: Hama Hamaphot KG Hanke & Thomas, Monheim, Fed. Rep. of Germany

[21] Appl. No.: 936,076

[22] Filed: Aug. 23, 1978

[51] Int. Cl.[3] ..... B65H 45/00; B65H 21/00

[52] U.S. Cl. ..... 493/381; 156/157; 156/443; 493/383; 493/446

[58] Field of Search ..... 270/61 R, 68 R; 156/157, 507, 443, 227, 505

[56] References Cited

U.S. PATENT DOCUMENTS

| | | | |
|---|---|---|---|
| 2,969,106 | 1/1961 | Reibel | 156/157 |
| 3,546,046 | 12/1970 | MacQueston | 156/157 |
| 3,717,535 | 2/1973 | Jorgensen | 156/443 |
| 3,904,472 | 9/1975 | Glaus | 156/443 |
| 3,914,491 | 10/1975 | Takahashi | 156/157 |

FOREIGN PATENT DOCUMENTS

| | | | |
|---|---|---|---|
| 2043672 | 3/1972 | Fed. Rep. of Germany | 270/61 R |

*Primary Examiner*—Edgar S. Burr
*Assistant Examiner*—A. Heinz
*Attorney, Agent, or Firm*—Ross, Ross & Flavin

[57] ABSTRACT

A film-splicer for splicing together the abutting ends of a pair of films by means of a splicing label having supporting paper strips and a intermediate tear off piece. A base pivotally mounts a film-turning windowed flap. A pair of film clamps on the flap allow the locating of the film-ends-to-be-joined relative to the flap. An upwardly-facing projection extends upwardly from the base and through the window in the flap. Prongs extend upwardly from the projection for aligning the splicing label relative to the abutting film-ends-to-be-joined. A cam is pivotally mounted on the base. A folding and detaching pin has opposite free ends, is pivotally mounted on the flap, and extends across the window. The tear-off piece is folded in a hairpin-like manner around the pin by means of the cam. The pin is movably mounted on the flap and is movable between a position of rest with its free ends firmly resting on the flap and to an intermediate position at a distance from the flap defining a space between the flap and pin for ready access from at least one of the free ends of pin.

7 Claims, 13 Drawing Figures

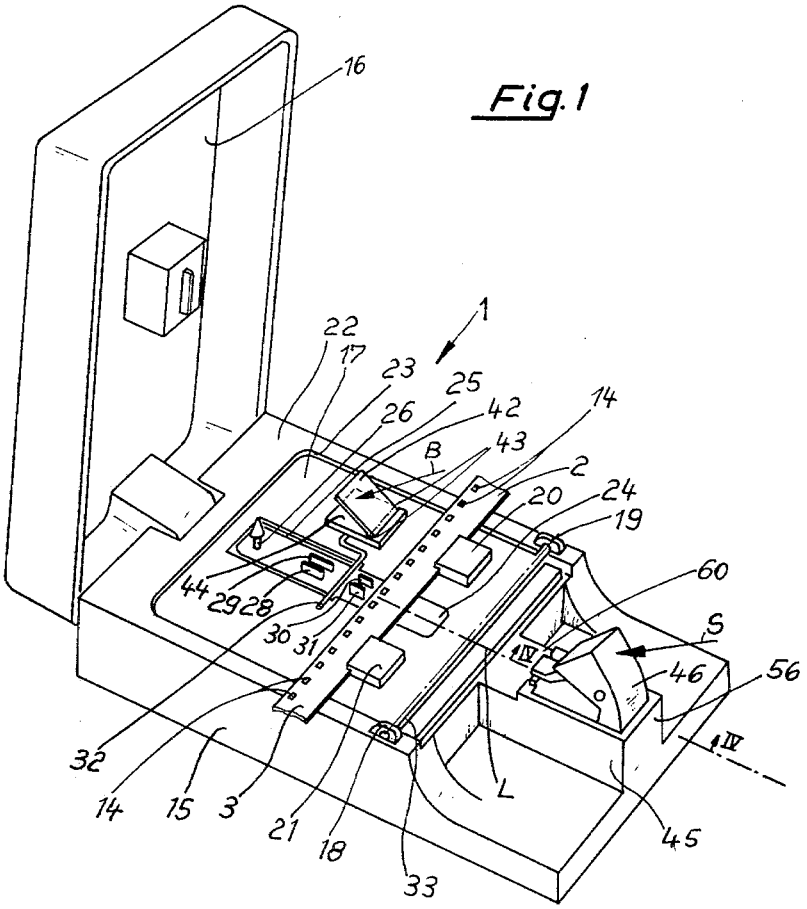
Fig. 1
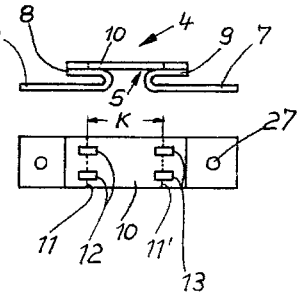
Fig. 2a
Fig. 2b
Fig. 3
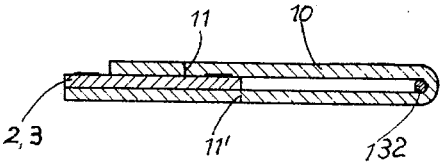

FILM SPLICER

FIELD OF THE INVENTION

The invention relates to a film splicer with a base and a film turning flap, which comprises a window for passing therethrough a projection attached to the base and provided with prongs for aligning a splicing film, which serves for joining the film ends and comprises a tear-off strip; there being provided on the flap a pin which crosses the window and around which the tear-off strip can be folded in a hairpin-like manner by means of a cam on the base and can be detached therefrom.

By making use of such a film splicer, film ends can be firmly connected together by means of an adhesive film; an intermediate piece on the adhesive film being looped round the pin crossing the flap and its window. The intermediate piece, which forms a tear-off strip, is detached at the film join by beams of a wedge on the cam hinged on the film splicer following the completion of the spliced connection. The now fixedly joined film ends can then be withdrawn from the film splicing press. In order to ensure that the film splicing press can be used again thereafter, the tear-off strip has to be removed from the pin on the film turning flap. Until now, the pin has been fixedly connected to the flap. Therefore, it has not always been easy to remove the tear-off strip.

OBJECT OF THE INVENTION

An object of the invention is to design a film splicer of the indicated kind in such a way that the tear-off strip can be easily removed from the pin.

BRIEF STATEMENT OF THE INVENTION

According to the invention, the indicated task is solved in that the pin is designed so that it can be moved from a position of rest, in which its free ends firmly rest on the flap, to an intermediate position which is accessible without hindrance from at least one free end. Advantageously, the pin is formed as the overhung crank of a front crank, whose shaft is pivotally mounted on the flap. It is recommended to make the design in such a way that the crank shaft forms part of a dounle-ended overhung front crank, whose one crank forms the pin while the other crank forms a return spring.

In a further development of this construction, it is favourable if the other crank is designed as a torsion spring bar and if there acts on this latter a leg whose free end merges in a fixed link which is parallel to the crank shaft, the leg being somewhat shorter than the cheek from which the torsion spring bar proceeds and this cheek forming, relative to the cheek of the crank forming the pin, an angle which is between 100° and 145°. It is furthermore of advantage if a key is pivotally hinged on the flap at an inclination so that, when it is in the position of rest, it loosely rests with its free end against the torsion spring bar. In this design, it suffices to depress the key in order to cause the pin, around which the tear-off strip is looped after having been detached, to swing upwards. Due to the fact that the pin is designed as an overhung crank, the tear-off strip located thereon can be readily slipped over the free end of the crank. As soon as the key is subsequently released, the crank returns to its position of rest, in which the pin rests at both ends firmly on the flap. It is furthermore particularly favourable if there are provided in the flap recesses into which the pin can be inserted with its ends in a flush manner in its position of rest.

BRIEF DESCRIPTION OF THE DRAWINGS

Further advantages and features will be explained in the following description of the drawings which illustrate an exemplified embodiment and in which:

FIG. 1 shows the splicer diagrammatically;

FIG. 2*a* is a view in side elevation of the splicing label;

FIG. 2*b* is a view in top plane of the splicing label;

FIG. 3 shows a section through the joined film ends before the tear-off strip is detached;

DESCRIPTION OF A PREFERRED EMBODIMENT

Figure 4:
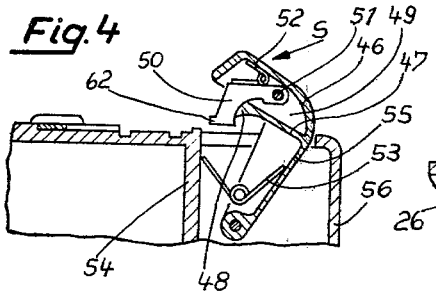
FIG. 4 shows a section along the line IV—IV in FIG. 1.

The film ends 2 and 3 are joined together by means of the film splicer 1 and by making use of a splicing label 4. Such a splicing label is composed of a splicing film 5 and two supporting paper strips 6, 7 which are folded in a hairpin-like manner and to whose short legs 8, 9 the splicing film 5 adheres with its adhesive surfaces. The intermediate piece 10 of the splicing film 5 is free from adhesive. This intermediate piece 10 is later detached; it forms a tear-off strip. To ensure that the detachment is effected at the intended place, there are provided perforations 11 and 11'. Furthermore provided in the splicing label 4 are holes 12, 13 which have the same distance from one another as the feed holes 14 have from one another.

The film splicer 1 comprises a base 15 with a cover 16 hinged thereon. On the top of the base 15, the film turning flap 17 is pivotally mounted in the bearings 18, 19. The flap 17, which is substantially formed by means of a flat plane-parallel plate, comprises pins which are placed into the holes 14 of the film ends 2, 3. Furthermore, there are fitted on the flap 17 two film clamps 20, 21, by means of which the film ends 2, 3 to be joined are fixed on the flap 17.

In the top 22 of the base 15, there is provided a depression 23, into which the flap 17 can be placed so that its top, in the position shown in FIG. 1, lies in a common plane with the top 22. Within the depression 23, there is arranged a longitudinally extending, upwardly projecting projection 24, whose top lies in a common plane with the top 22.

In the flap 17, there is provided a window 25, through which the projection 24 freely passes in the position of the flap 17 shown in FIG. 1.

Fitted on the projection 24 is the peg 26 which projects freely upwardly and comprises an undercut beneath its point and which serves for holding the splicing label by means of the hole 27 (FIG. 2).

Furthermore fitted on the projection 24 are the upwardly projecting prongs 28, 29 and 30, 31 which cooperate with the holes 12 and 13 in the splicing label 4 (FIG. 2).

A pin 32 passes through the window 25 between the prongs 28, 29 and 30, 31. This pin 32 extends largely parallel to the swivel shaft 33 on the flap 17. The pin 32 serves for folding and detaching the intermediate piece 10 of the splicing film 5.

Figure 10:
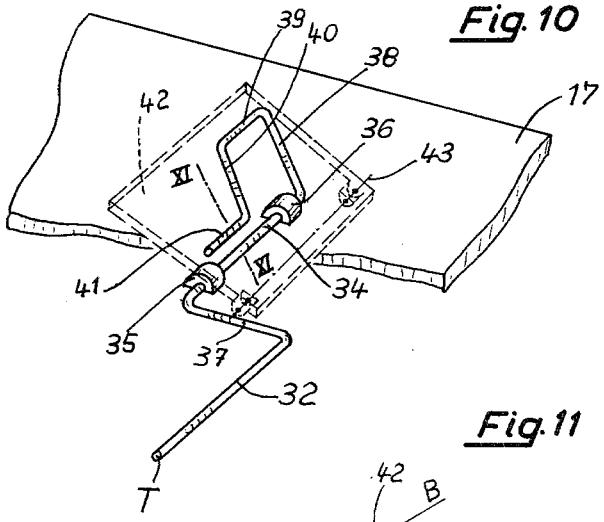
FIG. 10 shows the film turning flap with the crank and the torsion return spring.
Figure 11:
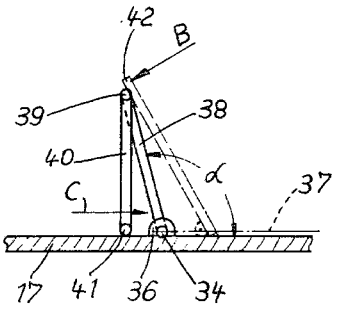
FIG. 11 shows a section along the line XI—XI in FIG. 10.

In the exemplified embodiment shown, the pin 32 is formed by means of elastic steel wire (piano wire) which has been bent substantially into the shape that can be seen in FIG. 10. Accordingly, the steel wire is substantially shaped as a double-ended overhung crank shaft, of which one crank pin forms the pin 32; the crank shaft 34 being pivotally mounted in the bearing blocks 35, 36 which are fixedly fitted on top of the flap 27. The crank cheek 37, from which the crank pin 32 and the crank shaft 34 branch off, forms relative to the crank cheek 38 an angle $\alpha$ of approximately 120°. The crank cheek 38 merges in the crank pin 39, from which the leg 40 branches off, which finally merges in the fixed link 41. The fixed link 41 is supported on the top of the flap 17 (FIG. 11).

Furthermore, a key 42 is pivotally hinged on top of the flap 17 at 43. A cover plate 44 (FIG. 1) covers the bearing blocks 36, 36 and the bearing point 43 of the key 42. The key 42 rests with its free front end against the crank pin 39. In this condition, the pin 32 lies at a and b flush in the flap 17, as shown in FIG. 1 and in full in FIG. 9.

Figure 9:
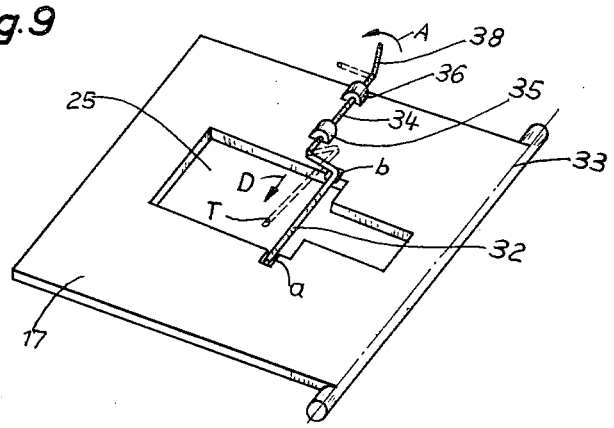
FIG. 9 shows the film turning flap with the crank.

When, as shown in FIG. 9 where the crank is only partly shown for illustration, the crank cheek 38 is swung by hand in the direction of the arrow A so that it is in the position shown in broken lines, the pin 32 is swung upwards, as shown in broken lines in FIG. 9. A spring—which is not shown in FIG. 9—endeavours to displace the crank cheek 38 in the opposite direction of the arrow A until the pin 32 lies again flush in the flap 17 at a and b.

The spring, which is not shown in FIG. 9 and which endeavours to swing the crank 38, 34, 37, 32 in the clockwise sense of rotation is formed by means of the crank pin 39, the leg 40 and the fixed link 41 (FIG. 10). The leg 40 is somewhat shorter in dimension than the crank cheek 38 is; in the exemplified embodiment, the leg 40 has a length of approximately 12,5 mm, whereas the crank cheek 38 measures approximately 13,5 mm.

When the key 42 (FIGS. 1 and 11) is depressed in the direction of the arrow B, the key 42 is swung in the anticlockwise sense of rotation. During this process, it presses against the crank pin 39 and causes the crank shaft 34 to be swung in the bearing blocks 35 and 36, also in the anticlockwise sense of rotation, so that the pin 32 is swung into the position shown in broken lines in FIG. 9. Furthermore, the fixed link 41 slides in the direction of the arrow C on the top of the flap 17. During this process, the crank pin 39 is resiliently twisted within itself in the anticlockwise sense of rotation. If the key 42 is now released, the crank pin 39, which has forcibly been twisted round its axis, acts as a torsion spring bar which wants to return to its starting position. Therefore, the crank pin 39 now rotates in the clockwise sense of rotation so that the fixed link 41 slides in the direction opposite to the arrow C on the top of the flap 17 and the crank cheek 38 is swung in the closkwise sense of rotation while taking along the crank shaft 34 round the longitudinal axis thereof. Consequently, the crank cheek 37 is also swung in the clockwise sense of rotation until the pin 32 rests again flush within the flap 17 at a and b (FIG. 9).

On the base 15, a cam 46 is pivotally mounted on a projection 45. The cam 46 is of hollow design (FIG. 4). From its rear wall, there proceeds a solid member 47 which ends in a wedge 48. The angular pressure stirrup 50 is pivotally mounted at 51 on the side walls 49 in the interior of the cam 46. A two-leg spring 52 endeavours to press the pressure stirrup 50 continuously downwards with one leg. In the position shown in FIG. 4, the leg of the pressure stirrup 50, which has been pressed downwards, comes to rest against the wedge 48. The wedge 48 thus limits the swivel movement of the pressure stirrup 50 directed in the opposite direction to the clockwise sense of rotation.

A two-leg spring 53 between the base wall 54 and the rear wall 55 of the cam 46 endeavours to press the cam 46 as far as possible against the front wall 56 of the projection 45.

Figure 5:
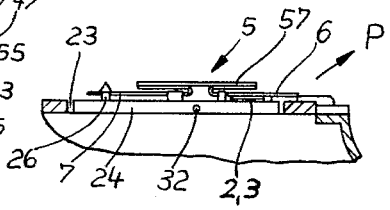
FIG. 5 shows a cut-out of the film splicer shown in FIG. 1, with superimposed film ends at the beginning of the splicing operation.
Figure 6:
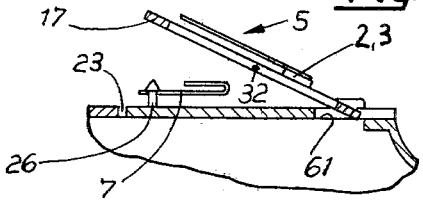
FIG. 6 shows a representation like that of FIG. 5 in an intermediate phase of the splicing operation.

When it is intend to produce a spliced connection between the film ends 2 and 3, the film ends 2 and 3 are placed on the flap 17 in the position shown in FIG. 1 in such a way that their joint abutment comes to lie on the longitudinal centre line L. Thereafter, a splicing label 4 is placed over the peg 26 by means of the hole 27 in the supporting paper strip 7, as can be seen in FIG. 5, the splicing label 4 extending approximately at right angles to the film ends 2, 3. In the position shown in FIG. 5, the supporting paper strip 6 is then manually pulled off approximately in the direction of the arrow P. The splicing surface 57 of the splicing film 5, which is thus released, now directly touches the tops of the film ends 2, 3 in the area of their joint abutment and adheres to the film ends 2, 3. Now the flap 17 is swung upwards in the clockwise sense of rotation (FIG. 6). During this process, the supporting paper strip 7 is caught on the peg 26, due to the undercut thereof. When the flap 17 is completely turned over (FIG. 7), the splicing film is pressed against the vertically upwardly extending edge 58 (FIG. 8*a*) of the strip 59 of the projection 45 on the base 15, which strip is arranged parallel to the swivel shaft 33, by the pin 32 which lies flush in the flap 17 at a and b (FIG. 9). Consequently, the free leg 5′ of the splicing film 5 is bent so that it extends upwardly, as emerges approximately from FIG. 7. The distance M of the edge 58 from the swivel shaft 33 is longer, by the thickness of the splicing film 5 and by a small clearance, for example of the order of the thickness of notepaper, than the maximum distance N of the pin 32 from the swivel shaft 33. The distance N is approximately identical with half the length K of the intermediate piece 10, which forms the tear-off strip. The top 60 (FIG. 1) of the projection 45 lies approximately in a common plane with the bottom 61 (FIG. 6) of the depression 23.

Figure 7:
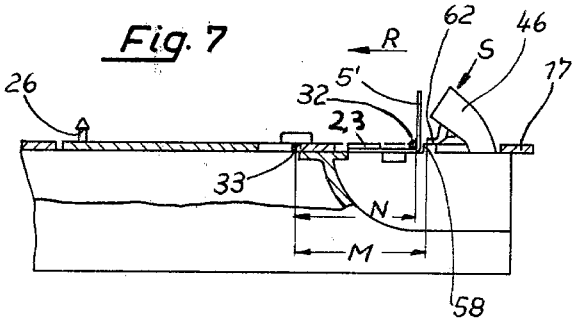
FIG. 7 shows a representation like FIGS. 5 and 6 in a more advanced phase of the splicing operation.
Figure 8:
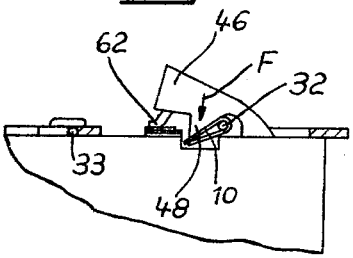
FIG. 8 shows a representation like FIGS. 5 to 7 in the end phase of the splicing operation.
Figure 8A:
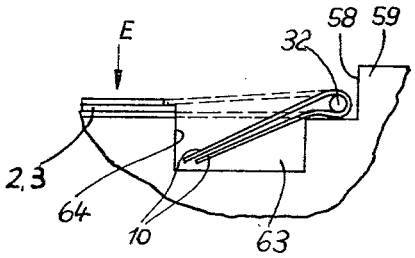
FIG. 8*a* shows an enlarged cut-out from FIG. 8.

When the production of the spliced connection has reached the phase captured in FIG. 7, then the cam 46 is pressed by hand in the direction of the arrow S. During this process, the shoe 62 on the pressure stirrup 50 is taken against the free leg 5′ of the splicing film 5 and presses this free leg 5′, as it continues to slide in the direction of the arrow R, round the pin 32 so that the free leg 5′ comes to lie with its adhesive surface on the undersides of the film ends 2, 3. During this process, the set consisting of the film ends 2, 3 and the adhesive surfaces of the splicing film 5 is firmly compressed in the direction of the arrow E. There is thus formed in the area of the joint abutment of the film ends 2, 3 a firm spliced connection, as shown in FIG. 3.

As the cam 46 is swung in the direction of the arrow A, the downwardly directed leg of the pressure stirrup 50 is lifted from the wedge 48 because the shoe 62 comes to rest against the free leg 5' of the splicing film. As the shoe 62 continues to be moved forward in the direction of the arrow R, the wedge 48 finally passes, in the area of the groove 63, onto the intermediate piece (tear-off strip) 10 which is looped round the pin and which now extends in two layers. As the pressing of the cam 46 continues in the direction of the arrow S, the pressure exerted by the wedge 48 in the direction of the arrow F on the tear-off strip 10 above the groove 63 becomes so strong that it presses the tear-off strip 10 along the edge 64 into the groove 63. Consequently, the tear-off strip 10 is detached along the perforations 11, 11'. When the cam 46 is subsequently released and the flap 17 is swung back to the starting position shown in FIG. 1, the spliced film can be removed from the splicer.

In order to be able to remove the tear-off strip 10 easily from the pin 32,—the flap 17 being again in the starting position shown in FIG. 1—the key 42 is now depressed by hand in the sense of the arrow B. This causes the pin 32 to be swung to the position shown in broken lines in FIG. 9. Thereafter, the tear-off strip 10, which is looped round the pin 32, is slipped by hand from the pin 32 in the direction of the arrow D. This is easily possible because, as it was swung to the position shown in broken lines in FIG. 9, the pin 32 was lifted at its free end T from its flush position at a in the flap 17 and is disposed, with its free end T, in a freely accessible and overhung manner above the flap 17 and the window 25.

During the swivelling of the pin 32 to the position shown in broken lines in FIG. 9, the torsion spring bar 39 has been tensioned. As soon as the key 42 is released, the torsion spring bar 39 is untensioned again. The untensioning of the torsion spring bar 39 causes the pin 32 to swing back to the starting position (FIG. 1; solid—line representation in FIG. 9).

What is claimed is:

1. In a film-splicer for splicing together the abutting ends of a pair of films (2 and 3) by means of a splicing label (4) having holes (12,13) and having supporting paper strips (6 and 7) and an intermediate tear-off piece (10), the improvement comprising:

a base (15) having a planar top (22) and a well (23) extending inwardly from the top, a film-turning flap (17) having a planar top and being pivotally mounted relative to the base and seated within the well with the top of the flap and the top of the base being substantially coplanar, an aperture (25) extending through the flap, a longitudinally-extending upwardly-projecting projection (24) mounted on the top of the base and extending upwardly through the aperture and having a top coplanar with the tops of the base and flap, a pair of film clamps (20,21) mounted on the top of the flap for orienting the film-ends-to-be-joined relative to the flap, a peg (26) fitted on the projection and extending upwardly therefrom and having an undercut for locating the splicing label, pairs of prongs (28, 29 and 30, 31) fitted on the projection and extending upwardly therefrom for cooperating with the holes in the splicing label for aligning the splicing label relative to the abutting film-ends-to-be joined, a wire having the configuration of a double-ended overhung crank shaft including first a crank shaft (34) pivotally mounted between its opposite ends relative to the top of the flap and second a crank cheek (37) branching from one end of the first crank shaft and third a crank pin (32) branching from the second crank cheek and having an opposite free end and fourth an auxiliary crank cheek (38) branching from the other end of the first crank shaft and fifth a crank arm (39) branching from the auxiliary crank cheek (38) and sixth a leg (40) branching from the crank arm (39) and seventh a fixed link (41) branching from the leg (40) and extending in a plane parallel to the crank shaft (34) and having a bearing support on the top of the flap, the crank pin (32) of the wire serving for folding thereabout and detaching the intermediate tear off piece of the splicing label and being extendable on top of the flap and across the aperture and between the pairs of prongs, a manually activatable cam (46) pivotally mounted on the base, a biased pressure stirrup (50) pivotally mounted relative to the cam for pressing downwardly on the splicing label into adhering engagement with the abutting film-ends-to-be-joined under influence of the cam and the folding of the tear piece around the crank pin (32) of the wire, the crank pin (32) of the wire being movable from a position of rest while resting upon the top of the flap to an intermediate position distantly of the flap with the free end thereof allowing the slippage of the tear-off strip therefrom.

2. A film-splicer as set forth in claim 1, including coaxially aligned recesses in the flap on opposite sides of the aperture for nestably receiving portions of the crank pin (32) of the wire in the position of rest.

3. A film-splicer as set forth in claim 1, including the auxiliary crank cheek (38) of the wire defining a handle for manually swinging the crank pin (32) in one direction from rest to intermediate position, and a spring means for biasing the crank pin in opposite direction from intermediate to rest positions against the manual swinging.

4. A film-splicer as set forth in claim 1, including the crank arm (39) of the wire defining a torsion spring with an inherent inclination to return to normal position as the wire is swung between rest and intermediate positions.

5. A film-splicer as set forth in claim 1, including the crank arm (39) of the wire defining a torsion spring and with the leg (40) of the wire being shorter in length than the auxiliary crank cheek (38) of the wire, and bearing blocks extending upwardly from the top of the flap for the journalling of the crank shaft (34) of the wire.

6. A film-splicer as set forth in claim 1, including a key (42) pivotally hinged on the top of the flap and having a free end loosely resting against the crank arm (39) of the wire in the rest position, with the key being firstly depressible in one sense of rotation for pressing against the crank arm (39) and rotating the crank shaft (34) of the wire in the corresponding sense of rotation for the swinging of the crank pin (32) from rest to intermediate position and sliding the fixed link (41) on the top of the flap and tensioning of the crank arm (39), and with the key (42) being secondly releasable the crank arm (39) being torsioned into return to rest position and the rotating of the crank arm (39) in opposite direction and the sliding of the fixed link (41) in opposite direction on the top of the flap and the swinging of the auxiliary crank cheek (38) in opposite rotation and the rotating of the crank shaft (34) in opposite direction and the return of the crank pin (32) again resting flush with the flap.

7. A film-splicer as set forth in claim 1, including, a key (42) pivotally mounted the top of the flap (17), and cover plate (44) for covering crank shaft (34) of the wire and the pivot of the key (42).

* * * * *